US006290478B1

(12) United States Patent
Lifson

(10) Patent No.: US 6,290,478 B1
(45) Date of Patent: Sep. 18, 2001

(54) ECCENTRIC BACK CHAMBER SEALS FOR SCROLL COMPRESSOR

(75) Inventor: Alexander Lifson, Manlius, NY (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/356,092

(22) Filed: Jul. 16, 1999

(51) Int. Cl.[7] ..... F03C 2/00
(52) U.S. Cl. ..... 418/55.4; 418/55.5; 418/57
(58) Field of Search ..... 418/55.4, 55.5, 418/57

(56) References Cited

U.S. PATENT DOCUMENTS

| | | | | |
|---|---|---|---|---|
| 4,992,032 | * | 2/1991 | Barito et al. | 418/55.4 |
| 5,040,956 | | 8/1991 | Barito et al. | 418/55.4 |
| 5,085,565 | * | 2/1992 | Barito | 418/55.5 |
| 5,622,488 | | 4/1997 | Tojo et al. | 418/5.5 |
| 5,857,844 | | 1/1999 | Lifson et al. | 418/55.5 |
| 5,989,000 | | 11/1999 | Tomayko et al. | 418/55.5 |

FOREIGN PATENT DOCUMENTS

| | | | |
|---|---|---|---|
| 421910 A1 | 9/1990 | (EP) . | |
| 478269 A1 | 9/1991 | (EP) . | |
| 631063 86 | 11/1988 | (JP) . | |
| 631063 87 | 11/1988 | (JP) . | |
| 631063 88 | 11/1988 | (JP) . | |
| 3172592 | 7/1991 | (JP) . | |
| 5-141201 | 6/1993 | (JP) | 418/55.4 |
| 9203413 | 3/1992 | (WO) . | |

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

A scroll compressor includes back-pressure chamber seals which are mounted eccentrically relative to a shaft rotational axis. Because of the seal eccentricity, the back chamber force, which prevents fixed and orbiting scroll separation, also acts eccentrically. The eccentric back chamber force creates an overturning moment. The direction of eccentricity is selected such that this overturning moment counteracts the scroll tipping moment of the tangential gas force. Therefore, the back chamber force and thrust force between the non-orbiting and orbiting scrolls are minimized. Also the back chamber area between the seals is reduced. The reduction of thrust force minimizes scroll wear and reduces friction, while back chamber area reduction frees up additional space in the scroll environment which can be utilized for other purposes.

15 Claims, 3 Drawing Sheets

ECCENTRIC BACK CHAMBER SEALS FOR SCROLL COMPRESSOR

BACKGROUND OF THE INVENTION

This invention relates to a back-pressure chamber for a scroll compressor wherein seals are positioned to reduce a thrust force between the two scroll members.

Scroll compressors are widely utilized in refrigerant compression applications. Generally, a scroll compressor includes two scroll members each having a base and a generally spiral wrap extending from the base. The wraps interfit to define compression chambers. A motor drives one scroll member to orbit relative to the other. Most scroll compressors have an axially compliant design. In this design, either the orbiting or non-orbiting scroll is allowed to move axially towards the other to minimize leakage between the floor of the scroll base and tips of the opposed scroll wraps by loading one scroll member against the other. This loading prevents the formation of gaps between the floor and tips of the scroll, thus minimizing leakage losses.

However, when the scrolls are loaded against one another, it is possible to damage the scroll components if the created thrust load becomes too high. Further, unwanted frictional losses also increase with increased loading. Thus, it is a goal of a scroll compressor designer to minimize the load as much as possible, while keeping the floor and the tip of the interfitting scroll wrap in contact with each other to avoid leakage.

There are several forces acting on the non-orbiting and orbiting scroll members, shown schematically in FIG. 1. As illustrated for the case of radially compliant orbiting scroll, a projection of a radial gas force vector $F_{rad}$ passes through a center line of the orbiting scroll 24, and acts at the midpoint of the wrap height. A tangential gas force vector $F_{tg}$ is perpendicular to the radial gas force and also acts at the midpoint of the wrap height. An axial gas force $F_{ax}$ is applied normal to the floor or plane of the orbiting scroll. As shown in FIG. 2, to assure that positive contact is maintained between the interfitting scroll members in axial direction, it is necessary to establish a $F_{BC}$ force which compensates for the force $F_{ax}$ separating the two scroll members, and also compensates for an overturning moment $M_{ov}$ which tips the orbiting scroll member relative to the non-orbiting scroll member. The overturning moment $M_{ov}$ is a product of $F_{tg}$ and an overturning moment arm $L_{ov}$ where $L_{ov}$ extends from the center of orbiting scroll bearing the center of the wraps. The radial gas force $F_{rad}$ also in theory has an impact on the overturning moment $M_{ov}$, but its effect is typically of a second order and is normally neglected in calculations of the overturning moment.

The compensating force $F_{BC}$ has been provided by tapping a pressurized fluid to a chamber behind one of the two scroll members. Pressurization of this chamber, known as a back-pressure chamber 28 establishes the compensating force $F_{bc}$ to counteract the separating force $F_{ax}$, and the overturning moment $M_{ov}$. Typically, back-pressure chambers are defined by at least two seal surfaces, that seal the back-pressure chamber from the suction pressure. The refrigerant is tapped to this chamber through an opening in one of the two scroll members to establish pressure in the back chamber that is higher than suction pressure. Since the pressure in the back chamber exceeds suction pressure, the compensating force $F_{bc}$ counteracts the separating force $F_{ax}$, and the overturning moment $M_{ov}$.

As shown in FIG. 3, in prior art designs of back-pressure chambers 28, both an inner seal 12 and an outer seal 10 have been positioned concentrically with respect to the crankcase bore 14. This crankcase seal arrangement while capable of creating a force that counteracts the separating force has the drawback of requiring a high back-pressure chamber force $F_{bc}$. As a result, a high thrust load as mentioned above has been encountered between the interfitting scroll members. It is a goal of this invention to reduce the thrust load between the interfitting scroll members.

SUMMARY OF THE INVENTION

In disclosed embodiments of this invention, at least one seal defining boundary of a back-pressure chamber is positioned off-center relative to a rotational axis of the shaft driving an orbiting scroll member. Because of the seal eccentricity, the back-pressure force vector $F_{bc}$ is also positioned eccentrically with respect to the shaft rotational axis. This eccentricity can be defined by a distance e. As a result of seal eccentricity, a moment $M_{BC}$ in the back-pressure chamber is created which is equal to $F_{bc}e$. The position of the eccentric seals or seals may be selected in such a way that the moment $M_{BC}$ counteracts the action of the scroll overturning moment $M_{ov}$, at the time during the cycle when $F_{tg}$ reaches its maximum value.

Stated another way, the position of the seal eccentricity may be chosen to provide the maximum benefit at the time when the scrolls are most prone to separate, which occurs when $F_{tg}$ is at maximum.

These and other features of the present invention can be best understood from the following specification and drawings, the following which is a brief description.

DETAILED DESCRIPTION OF A PREFERRED EMBODIMENT

Figure 5:
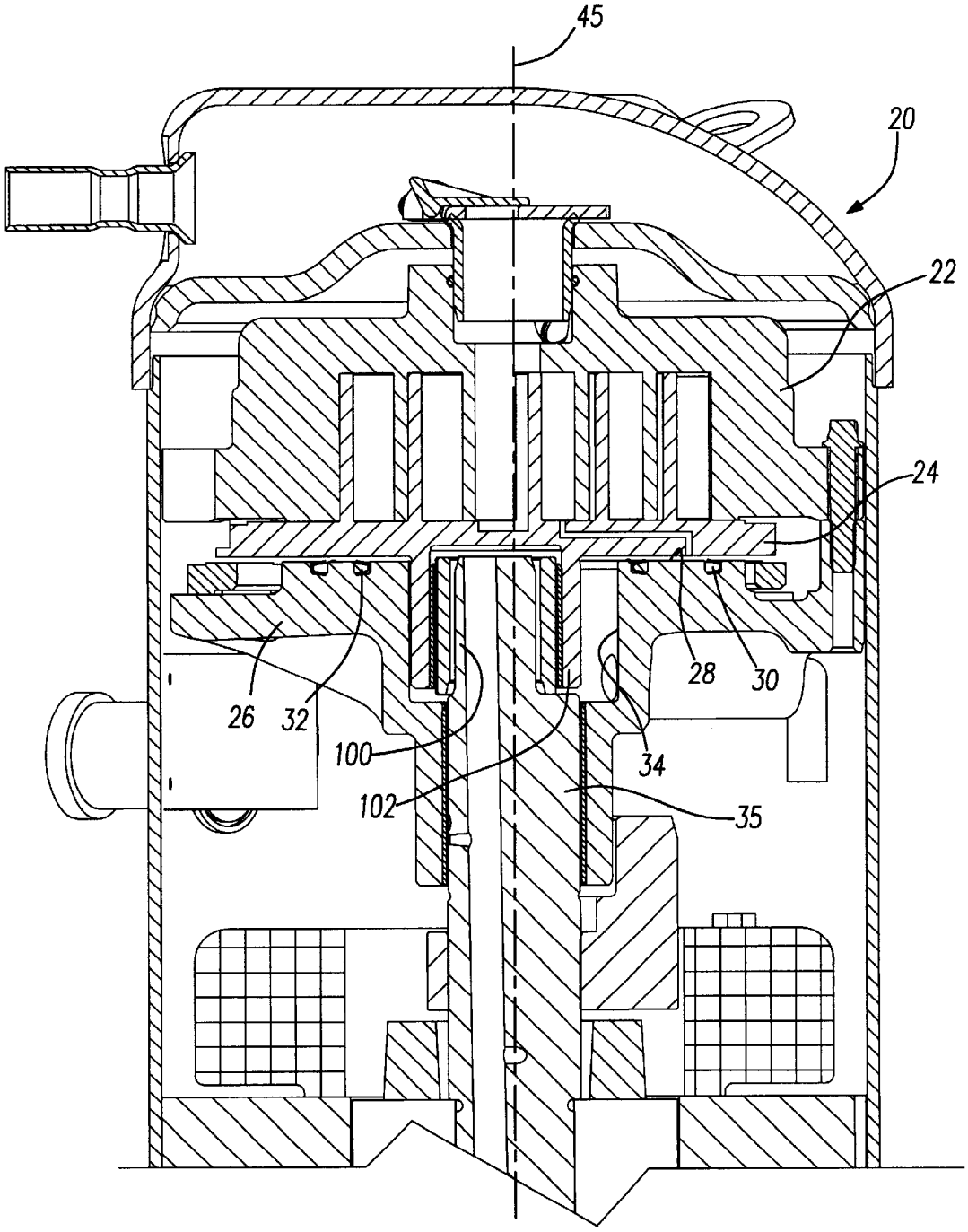
FIG. 5 is a cross-sectional view of a scroll compressor incorporating a first embodiment of the present invention.

A scroll compressor is illustrated in FIG. 5. As known, a fixed or non-orbiting scroll 22 has a wrap extending from a base and in a direction of an orbiting scroll 24 which also has a wrap extending from a base. The wraps of the scroll members 22 and 24 interfit to define compression chambers. In the illustrated embodiment, a crankcase 26 is secured in the compressor. The compressor is of the sort wherein the shaft 35 has an eccentric pin 100 extending upwardly into a downwardly extending boss 102 in the orbiting scroll 24. As known, rotation of the shaft 35 is translated into orbiting movement of the orbiting scroll 24. A back-pressure chamber 28 is defined between the crankcase 26 in the rear of the base of the orbiting scroll 24. It should be understood that the back-pressure chamber could be behind the non-orbiting scroll 22. The aspects of this invention are equally applicable to such scroll compressors.

Figure 6:
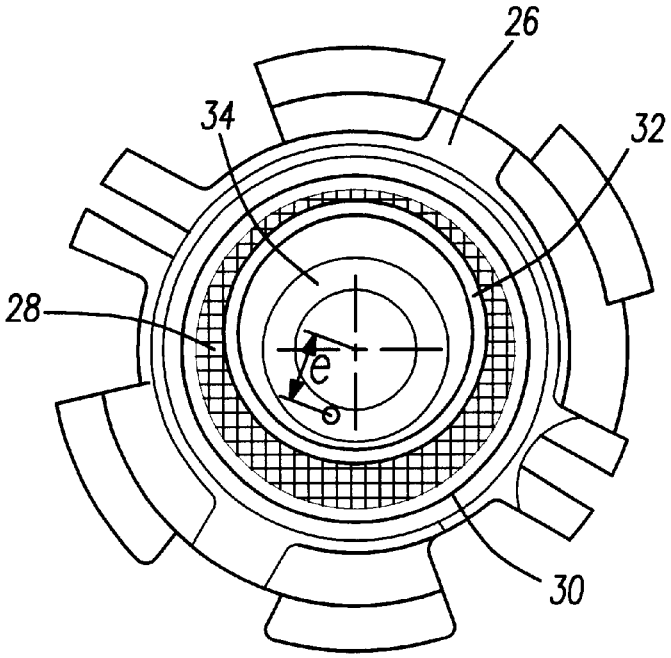
FIG. 6 is a top view of the crankcase incorporating the first embodiment as shown in FIG. 5.

The back-pressure chamber 28 is sealed by a pair of seals 30 and 32 mounted in the crankcase 26. The inner seal 32 in FIGS. 5 and 6 is shown eccentrically positioned relative to a bore 34 in the crankcase 26. The outer seal is shown centered with respect to the bore 34. Bore 34 generally coincides with a rotational axis 45 of the drive shaft 35 for driving the orbiting scroll 24.

As known, pressurized refrigerant from the compression pockets is tapped into the back-pressure chamber. The scroll member 24 is biased toward the scroll member 22 by the back chamber force. Since the seal 32 is eccentrically mounted, a vector of the back chamber force $F_{BC}$ is located eccentrically with respect to the bore 34. Thus, the back-pressure chamber 28 could be said to be off-center relative to the bore 34.

Figure 1:
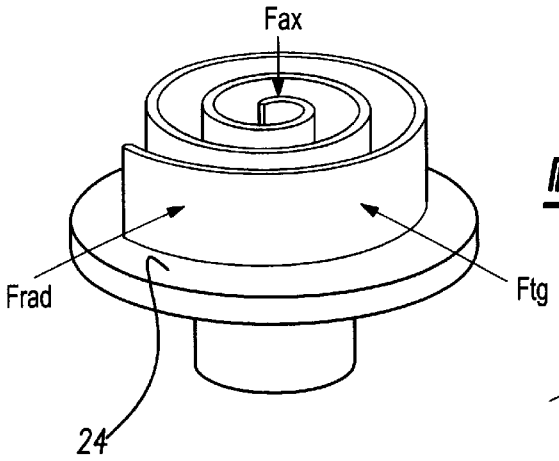
FIG. 1 shows a schematic of forces acting on an orbiting scroll.
Figure 2:
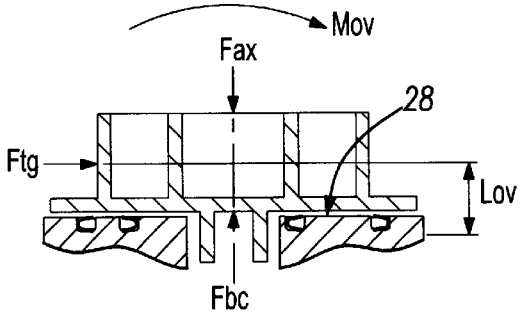
FIG. 2 shows a schematic of forces and moments acting on an orbiting scroll with the prior art back chamber seal arrangement.
Figure 3:
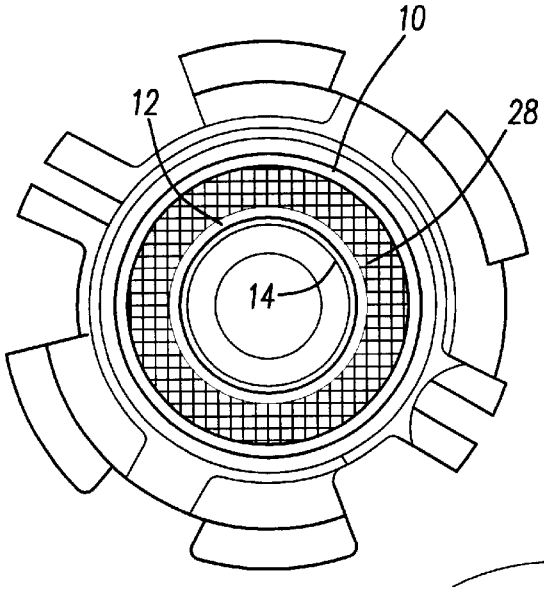
FIG. 3 shows a top view of a crankcase with a prior art back chamber seal arrangement.
Figure 4:
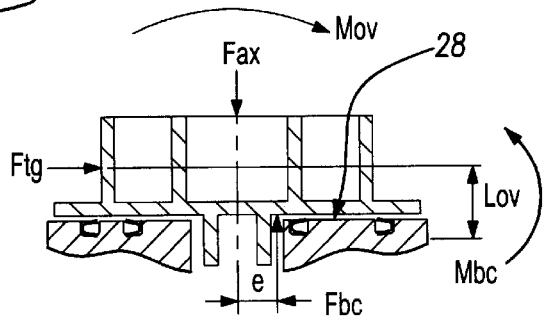
FIG. 4 shows a schematic of forces and moments acting on an orbiting scroll with the inventive eccentric back chamber seal arrangement.

As explained in FIG. 4, due to the eccentricity e, the back-pressure chamber force $F_{bc}$ creates a moment $M_{BC}$ acting in a direction opposite to the moment $M_{ov}$ created by the tangential gas force $F_{tg}$. The eccentric location of the seal 32 in general is selected such that the counteracting effect of the moment $M_{BC}$ reaches its maximum at approximately the same time when the force $F_{tg}$ is also at its maximum.

Figure 7:
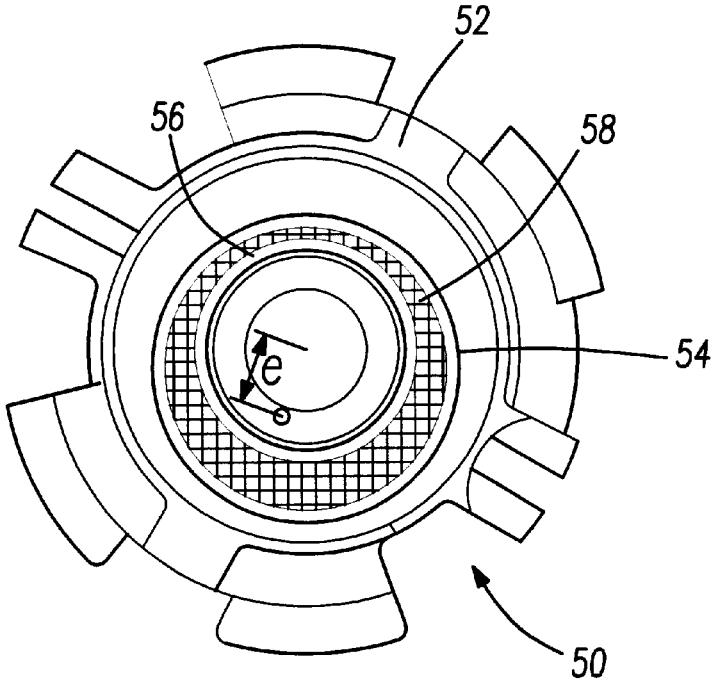
FIG. 7 shows a top view of a crankcase incorporating a second embodiment.

FIG. 7 shows a second embodiment 50, wherein the crankcase 52 has seals 54 and 56. A back-pressure chamber 58 is defined between the seals 56 and 54 in this embodiment. Outer seal 54 is positioned eccentrically, and the inner seal 56 is centered relative to the axis of the bore 34. The basic function is the same. As the vector of force $F_{bc}$ is located eccentrically with respect to the bore 34, and the benefits of creating a counteracting moment as mentioned above will be achieved. Moreover, there is an additional surface area outside of the back-pressure chamber available as shown by the FIG. 7 embodiment. This area is adjacent to the seal 54 in the crankcase 52. This surface area can be utilized by the scroll compressor designer for a variety of additional functions such as for example, an increase in orbit radius to boost the compressor capacity, or an increase in the Oldham coupling width to increase its strength.

As shown above, the invention is illustrated by an arrangement wherein the back-pressure chamber is adjacent to the orbiting scroll. However, the invention is similarly applied to a back-pressure chamber arrangement wherein the backpressure chamber is adjacent to the non-orbiting scroll. Also, while a pair of seals are shown to define the back-pressure chamber, it should also be understood that some scroll compressors may use a single seal, or more than two seals to define the back-pressure chamber. The present invention would provide similar benefits to those mentioned above.

While the illustrated embodiments show arrangements wherein one of two seals is located eccentrically, it should be understood that both seals could be located eccentrically. Further, while the above-referenced embodiments show circular seals, it should also be understood that the seals could be oval, egg-shaped, or other shapes.

(A) All that is required with any seal shape or arrangemnent is that the area of the back-pressure chamber be offset from the central axis such that the force vector $F_{BC}$ is also eccentric relative to the central axis. As is clear from the drawings, the back pressure chambers in each of the embodiments have a relatively fixed cross-sectional area which will not change during the orbital movement of the orbiting scroll.

Although preferred embodiments of this invention have been disclosed, it should be understood that a worker in this art would recognize that various modifications would come within the scope of this invention. For that reason, the following claims should be studied to determine the true scope and content of this invention.

What is claimed is:

1. A scroll compressor comprising:

a first scroll member having a base plate and a generally spiral wrap extending from said base plate;

a second scroll member having a base plate and a generally spiral wrap extending from said base plate, said spiral wraps of said first and second scroll members interfitting to define compression chambers;

a back-pressure chamber defined on a side of said base plate of one of said first and second scroll members removed from the other of said first and second scroll members;

said second scroll member orbiting relative to said first scroll member and being driven by a shaft, said shaft having a pin extending upwardly into a boss in said second scroll member to communicate rotational drive of said shaft into orbiting movement of said second scroll member, said shaft defining a rotational axis; and said back-pressure chamber being off-center relative to said axis, said back pressure chamber having a relatively fixed cross-sectional area which does not change during the orbital movement of said second scroll member.

2. A scroll compressor as recited in claim 1, wherein said back-pressure chamber is defined by a pair of seals with one seal being spaced radially inwardly from the other, and at least one of said seals being eccentrically mounted relative to said axis.

3. A scroll compressor as recited in claim 2, wherein said second scroll member is supported in a crankcase housing, and said back-pressure chamber being defined between said crankcase housing and said second scroll member.

4. A scroll compressor as recited in claim 3, wherein said first and second seals are mounted in said crankcase housing.

5. A scroll compressor comprising:

a first scroll member having a base plate and a generally spiral wrap extend from said base plate;

a second scroll member having a base plate and a generally spiral wrap extend from said base plate, said spiral wraps of said first and second scroll members interfitting to define compression chambers;

a back-pressure chamber defined on a side of said base plate of one of said first and second scroll members removed from the other of said first and second scroll members;

said second scroll member orbiting relative to said first scroll member and being driven by a shaft, said shaft defining a rotational axis;

said back-pressure chamber being off-center relative to said axis;

said back-pressure chamber being defined by a pair of seals with one seal being spaced radially inwardly from the other, and at least one of said seals being eccentrically mounted relative to said axis; and an inner one of said seals is mounted eccentrically, and an outer one of said seals is centered on said axis.

6. A scroll compressor comprising:

a first scroll member having a base plate and a generally spiral wrap extending from said base plate;

a second scroll member having a base plate and a generally spiral wrap extending from said base plate, said spiral wraps of said first and second scroll members interfitting to define compression chambers;

a back-pressure chamber defined on a side of said base plate of one of said first and second scroll members removed from the other of said first and second scroll members;

said second scroll member orbiting relative to said first scroll member and being driven by a shaft, said shaft defining a rotational axis;

said back-pressure chamber being off-center relative to said axis;

said back-pressure chamber being defined by a pair of seals with one seal being spaced radially inwardly from the other, and at least one of said seals being eccentrically mounted relative to said axis; and an inner one of said seals is mounted concentrically with said axis and an outer one of said seals is mounted eccentrically relative to said axis.

7. A scroll compressor as recited in claim 1, wherein said back-pressure chamber is defined by a seal which is eccentrically mounted relative to said axis.

8. A scroll compressor comprising:

a first scroll member having a base plate and a generally spiral wrap extending from said base plate;

a second scroll member having a base plate and a generally spiral wrap extending from said base plate, said spiral wraps of said first and second scroll members interfitting to defined compression chambers;

a back-pressure chamber defined on a side of said base plate of one of said first and second scroll members removed from the other of said first and second scroll members;

said second scroll member orbiting relative to said first scroll member and being driven by a shaft, said shaft defining a rotational axis;

said back-pressure chamber being off-center relative to said axis;

said back-pressure chamber being defined by a pair of seals with one seal being spaced radially inwardly from the other, and at least one of said seals being eccentrically mounted relative to said axis; and said back-pressure chamber is offset in a first direction, said first direction being selected to be optimally beneficial in counteracting an overturning moment created by a tangential gas force moment when the moment is near its maximum during the operational cycle of said scroll compressor.

9. A scroll compressor comprising:

a first scroll member having a base and a generally spiral wrap extending from said base;

a second scroll member having a base and a generally spiral wrap extending from said base, said spiral wraps of said first and second scroll members interfitting to define compression chambers, and said scroll compressor having a tangential gas force acting to overturn said scroll members;

said second scroll member orbiting relative to said first scroll member, and a shaft for driving said second scroll member, said shaft centerline defining a rotational axis;

a back-pressure chamber defined behind said base plate of one of said first and second scroll members removed from the other of said first and second scroll members, said back-pressure chamber having a surface area which is off-center relative to said axis, and being designed to establish an off-center back chamber force vector that at least partially counteract the overturning effect of said tangential gas force, said back-pressure chamber is offset along a first direction, said first direction being selected to be generally parallel to the direction of the vector of a tangential gas force which is encountered during the operational cycle of said scroll compressor.

10. A scroll compressor as recited in claim 9, wherein said back-pressure chamber is defined by a pair of seals with one seal being spaced radially inwardly from the other, and at least one of said seals being eccentrically mounted relative to said axis.

11. A scroll compressor as recited in claim 10, wherein said second scroll member is supported in a crankcase housing, and said back-pressure chamber being defined between said crankcase housing and said second scroll member.

12. A scroll compressor as recited in claim 11, wherein said first and second seals are mounted in said crankcase housing.

13. A scroll compressor as recited in claim 12, wherein an inner one of said seals is mounted eccentrically, and an outer one of said seals is centered on said axis.

14. A scroll compressor as recited in claim 10, wherein an inner one of said seals is mounted concentrically with said axis and an outer one of said seals is mounted eccentrically relative to said axis.

15. A scroll compressor as recited in claim 9, wherein said back-pressure chamber is defined by a seal which is eccentrically mounted relative to said axis.

* * * * *